US005855021A

United States Patent [19]

Somerville

[11] Patent Number: 5,855,021

[45] Date of Patent: Jan. 5, 1999

[54] TOWEL GARMENT

[76] Inventor: Reginald L. Somerville, 399 Maxwell, Pontiac, Mich. 48342

[21] Appl. No.: 599,543

[22] Filed: Feb. 6, 1996

[51] Int. Cl.[6] ..... A41B 1/00

[52] U.S. Cl. ..... 2/84; 2/69

[58] Field of Search ..... 2/84, 46, 48, 51, 2/69, 88, 104, 115, 243.1; D2/718–720, 724–861, 823–826, 828, 739, 830

[56] References Cited

U.S. PATENT DOCUMENTS

| | | | |
|---|---|---|---|
| 1,243,206 | 10/1917 | Norman | 2/84 |
| 1,432,249 | 10/1922 | Hoyme | 2/69 |
| 1,497,685 | 6/1924 | Hoyme | 2/69 |
| 3,013,274 | 12/1961 | Dike | 2/69 |
| 3,079,611 | 3/1963 | Boryszewski | 2/69 |
| 3,618,139 | 11/1971 | Hugin | 2/115 |
| 4,571,743 | 2/1986 | Wagoner | 2/114 |
| 5,029,343 | 7/1991 | McIntyre | 2/115 |
| 5,075,901 | 12/1991 | Vollrath | 2/115 |

FOREIGN PATENT DOCUMENTS

| | | | |
|---|---|---|---|
| 451393 | 9/1949 | Italy | 2/84 |

*Primary Examiner*—Gloria M. Hale
*Attorney, Agent, or Firm*—John R. Benefiel

[57] ABSTRACT

A moisture absorber garment for use by athletes during playing breaks in which front and rear panels of a towel material such as terrycloth are joined along one side, with a head opening and hood at the juncture of the two panels. Upper arm covering sections of material project from each side.

4 Claims, 2 Drawing Sheets

TOWEL GARMENT

BACKGROUND OF THE INVENTION

This invention concerns towels and more particularly towels used by participants during sporting events.

Towels are commonly used by athletes during sporting contests. Basketball players in particular very often drape towels over their heads and shoulders when temporarily sidelined during the game. The towels are used to dry perspiration and also as a make-shift warmup suit. The lightly clad players often become sweaty and overheated by the exertions of the game, but desire some covering when on the sidelines for short intervals, since drafty conditions typically prevail in large arenas and soon becomes uncomfortable after a short period of inaction.

Putting on a regular warmup garment is often deemed too slow and cumbersome for players out of the game only for a short time. Additionally, there is often a need to towel off the head and face.

This situation has led players to drape towels around their heads and/or shoulders to keep players warm, which is relatively ineffective and outlandish in appearance.

It is the object of the present invention to provide an improved towel for use by sidelined athletes.

SUMMARY OF THE INVENTION

The above-recited object is achieved by forming toweling material into an easily donned garment which covers the head and shoulders of the wearer.

The garment is comprised of front and rear rectangular panels of towel material such as terrycloth, the panels joined along one side, with a head opening along the joined front and rear sides, and having an attached loosely fitting hood. Shoulder and upper arm extension sections project from either side of the joined panels. The front panel is significantly longer than the rear panel, allowing draping over the thighs of a seated wearer, and allowing convenient use for toweling the head and neck.

The separate front and rear panels allow the garment to be quickly and easily put on or taken off.

While terrycloth material is preferred, other towel material can be used.

DETAILED DESCRIPTION

Figure 1:
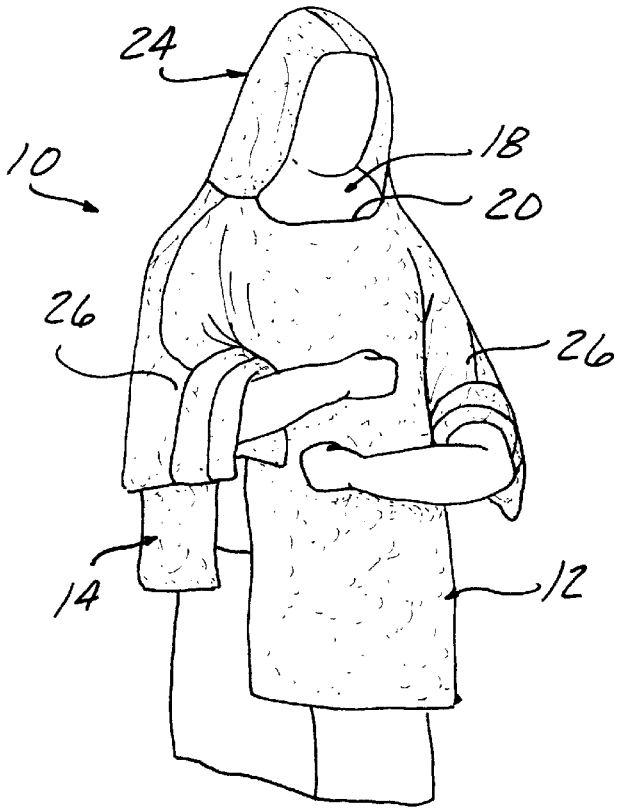
FIG. 1 is a perspective view of the towel garment according to the present invention being worn by a standing wearer.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, the towel garment 10 according to the present invention consists of a garment sewn from terrycloth or other good moisture absorbent fabric adapted to be easily put on or taken off, and worn over the head and shoulders of an athlete.

The garment consists of a generally rectangular front panel 12 and rear panel 14 sewn together along contiguous sides 16.

A large head opening 18 is formed by aligned scallops 20, 22 in each of the joined sides of the front panel 12 and rear panel 14.

A hood 24, sized to be loose fitting, is sewn to the rear of the head opening 18.

Shoulder and upper arm coverings 26, 28 extend from each side of the joined front and rear panels 12, 14 aligned with the head opening 18. The coverings 26, 28 comprise a generally rectangular sections projecting from the front and rear panels 12, 14 and also sewn on extender strips as shown.

Figure 2:
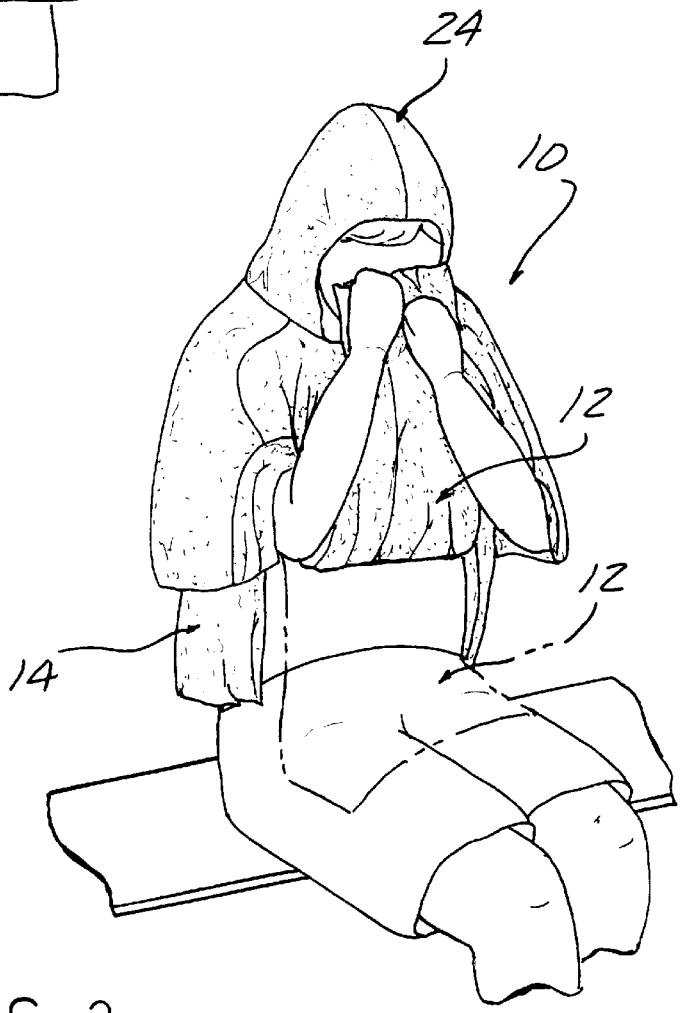
FIG. 2 is a perspective view of the towel garment shown in FIG. 1 being worn by a seated wearer, showing use of the front panel as a towel.
Figure 3:
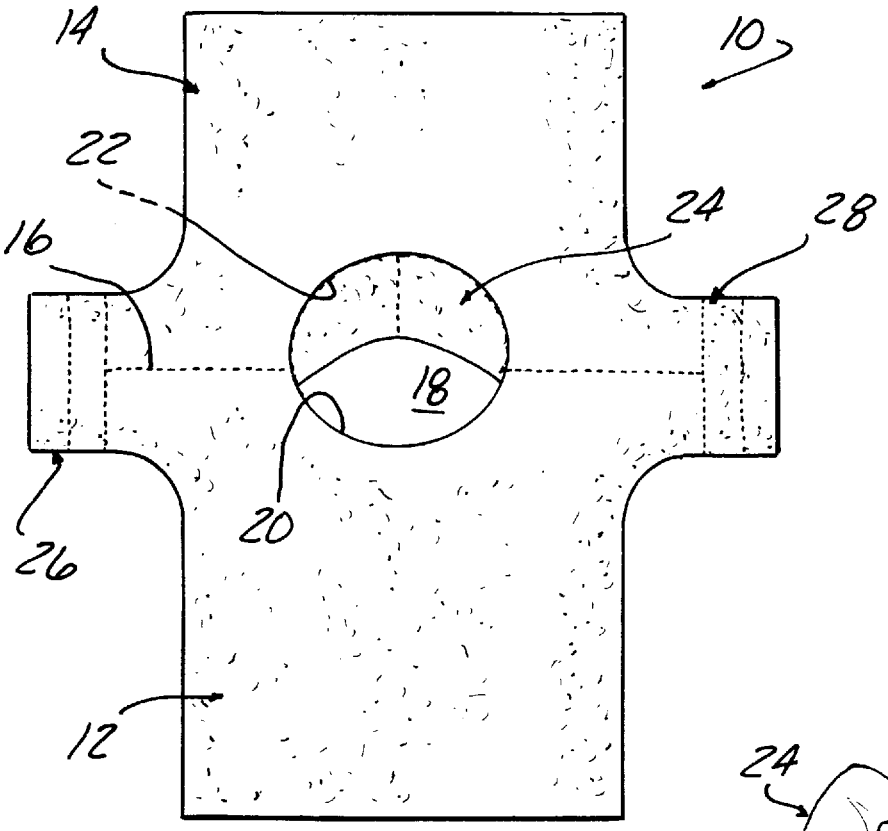
FIG. 3 is a plan view of the towel garment with the front and rear panels spread apart.
Figure 4:
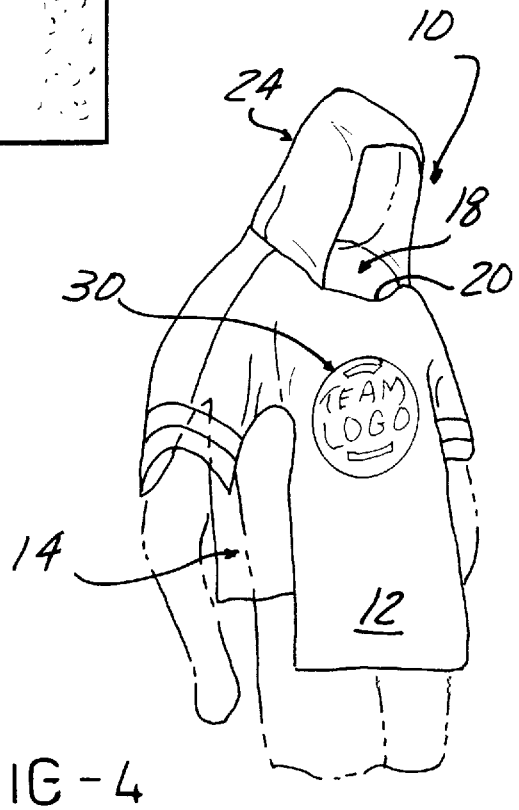
FIG. 4 is a perspective view of the towel garment shown in FIGS. 1–3 as draped when being worn to illustrate the open construction.

The front panel 12 is substantially longer than the rear panel 14 so that the lower region can be draped over the player's upper thighs as indicated in phantom in FIG. 2, but available for use as a towel for wiping the face as shown in FIG. 2 in solid lines.

The towel garment 10 is readily put on and/or taken off, due to the separation of the front and rear panels 12, 14 and the large sized head opening 18.

The arms of the wearer remain free due to the presence of the side slits created when the front and rear panels 12, 14 are draped over the wearer.

The resulting garment largely covers the upper arms, torso, head and upper legs of the wearer to also function as a warmup garment.

Large surfaces are available for team logos 30 to be well adapted to use by players in prep, collegiate, and professional team sports.

I claim:

1. A moisture absorber garment with a shirt like appearance comprising:

a front panel of moisture absorbent towel material;

a rear panel of moisture absorbent towel material joined along a top side to a top side of said front panel said rear panel extending downwardly to just about the waist of the wearer;

said front panel substantially longer than said rear panel extending to the thigh area of the wearer;

a shoulder and upper arm section of moisture absorbent material projecting from each side of both said front and rear panels, generally aligned with said joined top side of said front and rear panels, adjacent sides of said front and rear panels and upper arm sections open and hanging free so that the front panel can be readily used as a towel to wipe the wearer's face;

a central head opening in said garment extending through both of said joined front and rear panels; and, a hood of moisture absorbent towel material attached to said joined front and rear panels adjacent to said head opening.

2. The moisture absorber garment according to claim 1 wherein said moisture absorbent towel material is terrycloth.

3. The moisture absorber garment according to claim 1 further including a sports team logo on either said front or said rear panel.

4. The moisture absorber garment according to claim 1 wherein said front and rear panels are generally rectangular.

* * * * *